US011988125B2

(12) United States Patent
Martinez Gordon et al.

(10) Patent No.: US 11,988,125 B2
(45) Date of Patent: May 21, 2024

(54) METHOD FOR AUTOMATICALLY DETECTING CLOGGING OF A SENSOR PIPE EXTENDING BETWEEN A PRESSURE SENSOR AND AN EXHAUST MANIFOLD OF AN INTERNAL COMBUSTION ENGINE

(71) Applicant: VOLVO TRUCK CORPORATION, Gothenburg (SE)

(72) Inventors: José Luis Martinez Gordon, Lyons (FR); Hervé Queret, Saint-Just Chaleyssin (FR); Damien Daulon, Lyons (FR); Franck Chagnot Auclair, Sainte-Anne-sur-Gervonde (FR)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 17/793,703

(22) PCT Filed: Feb. 18, 2020

(86) PCT No.: PCT/EP2020/054181
§ 371 (c)(1),
(2) Date: Jul. 19, 2022

(87) PCT Pub. No.: WO2021/164849
PCT Pub. Date: Aug. 26, 2021

(65) Prior Publication Data
US 2023/0068752 A1 Mar. 2, 2023

(51) Int. Cl.
*F01N 11/00* (2006.01)
*F01N 13/00* (2010.01)

(52) U.S. Cl.
CPC ..... *F01N 11/002* (2013.01); *F01N 13/008* (2013.01); *F01N 2550/00* (2013.01);
(Continued)

(58) Field of Classification Search
CPC .. F01N 11/002; F01N 13/008; F01N 2550/00; F01N 2560/08; F01N 2590/08; F01N 2900/0422; F01N 2900/1406
See application file for complete search history.

(56) References Cited

U.S. PATENT DOCUMENTS

2004/0040285 A1* 3/2004 Strohmaier ..... F01N 11/002 60/277
2005/0178272 A1* 8/2005 Kariya ..... B01D 46/46 96/421

(Continued)

FOREIGN PATENT DOCUMENTS

DE 102008005989 A1 7/2009
DE 102012200917 A1 7/2013

(Continued)

OTHER PUBLICATIONS

International Search Report and Written Opinion of the International Searching Authority, PCT/EP2020/054181, dated Aug. 20, 2020, 11 pages.

*Primary Examiner* — Matthew T Largi
(74) *Attorney, Agent, or Firm* — Sage Patent Group

(57) ABSTRACT

The invention relates to a method for automatically detecting clogging of a sensor pipe extending between a pressure sensor and an exhaust manifold of an internal combustion engine, wherein the pressure sensor enables to record a signal representative of the relative pressure over time. The method includes at least one of the following steps:
(Continued)

a) determining, while the engine runs in a steady operation state, an average amplitude of oscillations of the signal over a first period of time, the sensor pipe being considered clogged when said average amplitude is lower than a first threshold;

b) monitoring, from the time the engine has been turned off, the signal over a second period of time, the sensor pipe being considered clogged when the integral of the signal is greater than a second threshold.

10 Claims, 5 Drawing Sheets

(52) U.S. Cl.
CPC ..... *F01N 2560/08* (2013.01); *F01N 2590/08* (2013.01); *F01N 2900/0422* (2013.01); *F01N 2900/1406* (2013.01)

(56) References Cited

U.S. PATENT DOCUMENTS

| | | | | |
|---|---|---|---|---|
| 2008/0314021 | A1* | 12/2008 | Sisken | F01N 9/002 60/274 |
| 2009/0211247 | A1* | 8/2009 | McEwan | F02B 37/18 60/602 |
| 2010/0139247 | A1* | 6/2010 | Hiemstra | F01N 3/22 60/287 |
| 2014/0069081 | A1* | 3/2014 | Tylutki | F01N 11/002 60/311 |
| 2014/0331752 | A1* | 11/2014 | Hall | F02D 41/146 73/114.75 |

FOREIGN PATENT DOCUMENTS

| | | | | |
|---|---|---|---|---|
| DE | 102017222313 | A1 | | 6/2019 |
| JP | 2018048561 | A | * | 3/2018 |
| JP | 2018048561 | A | | 3/2018 |

* cited by examiner

METHOD FOR AUTOMATICALLY DETECTING CLOGGING OF A SENSOR PIPE EXTENDING BETWEEN A PRESSURE SENSOR AND AN EXHAUST MANIFOLD OF AN INTERNAL COMBUSTION ENGINE

CROSS REFERENCE TO RELATED APPLICATIONS

This application is a 35 U.S.C. § 371 national stage application of PCT International Application No. PCT/EP2020/054181 filed on Feb. 18, 2020, the disclosure and content of which is incorporated by reference herein in its entirety.

TECHNICAL FIELD

The invention relates to a method for automatically detecting clogging of a sensor pipe extending between a pressure sensor and an exhaust manifold of an internal combustion engine.

The invention can be applied in medium and heavy-duty vehicles, such as trucks, buses and construction equipment. Although the invention will be described with respect to a truck, the invention is not restricted to this particular vehicle, but may also be used in other vehicles such as buses, working machines and boats.

BACKGROUND

In known manner, an internal combustion engine may include an exhaust pressure sensor for measuring the exhaust pressure (also known as "Back pressure") and use it as a control parameter of the engine. The exhaust pressure sensor is usually not directly connected to the exhaust manifold, but to a pipe which is connected to the exhaust manifold. This pipe should not be confused with the exhaust pipe which leads the exhaust gas to the atmosphere. To avoid any misunderstanding, the exhaust pressure sensor pipe will be named as "P3 pipe" in this paper.

The exhaust back pressure is the pressure measured in the exhaust manifold after the exhaust valves of the engine and before the turbine.

This pressure is controlled by means of the EPG (Exhaust Pressure Governor, also known as exhaust flap), mainly for two reasons:

The first reason is to perform an exhaust brake. Indeed, at increased exhaust back pressure levels, the engine has to compress the exhaust gases to a higher pressure, which involves additional mechanical work and/or less energy extracted by the exhaust turbine which can affect intake manifold boost pressure. Hence, the power will decrease resulting into an engine brake.

The second reason is to help the engine to quicker reach the correct work temperature. Over time, the exhaust sensor pipe (or P3 pipe) can get clogged with soot, or can rust through. All of these will degrade engine performance and reduce efficiency. A partially clogged P3 pipe will make, for instance, the exhaust sensor to slow down its measurements. This will have a negative side effect to the different Air & Gas actuators, especially to the exhaust flap. A wrong control of the exhaust flap could drive to critical effects on EATS (Exhaust After-Treatment System)

JP2018048561A discloses a clogging detection system for an exhaust pressure sensor tube 30a of an internal combustion engine and the associated method. This publication explains that if the tube 30a gets clogged, the pressure of the exhaust gas Ga in the exhaust passage 15 is not fully transmitted to the exhaust pressure sensor 30 and the pressure value P sensed by the exhaust pressure sensor 30 will be significantly smaller than the actual pressure. This publication teaches to monitor the exhaust back pressure when the exhaust brake valve 22 is closed. Normally, i.e. when the pressure sensor tube is clear (not clogged), the exhaust back pressure should raise significantly. If the sensor does not measure such pressure increase, it means that the pressure sensor tube is at least partly clogged. In practice, D1 teaches to compare the pressure value P measured by the sensor after the exhaust valve brake has been closed to a pre-set value P1, if P is inferior to P1, then it is considered that the pressure pipe ("P3 pipe") is clogged.

SUMMARY

An object of the invention is to provide a new method for the detection of P3 pipe clogging, which is simple for implementation (software solution) and which can be immediately available (without any supplementary hardware).

The method of JP2018048561A is based on the P3 sensor measures but the strategy is different from that of the invention. Typically, the method of the invention is not intrusive at engine level. To the contrary, the strategy of JP2018048561A involves to get the control over the exhaust flap to perform an analysis, while the strategy of the invention is fully transparent and does not need of any specific control over the different actuators. Another fact is that the method of the invention does not consist in comparing the measured pressure to a predefined value, but analyses and monitors its behaviour during the driving cycle. In the example, it seems that competitors are basing in absolute magnitude of P3 signal to perform an analysis instead of analysing its behaviour, thing that we have done in our solution.

The implementation of this new method will enable to save a lot of time and money in aftermarket operations. This solution will enable to perform predictive maintenance and inform the customer (vehicle's owner) that intervention is needed on the engine before a more severe problem happens.

The object of the invention is achieved by a method for automatically detecting clogging of a sensor pipe extending between a pressure sensor and an exhaust manifold of an internal combustion engine, wherein the pressure sensor enables to record a signal representative of the relative pressure over time. According to the invention, the method includes at least one of the following steps:

a) determining, while the engine runs in a steady operation state, an average amplitude of oscillations of the signal over a first period of time, the sensor pipe being considered clogged when said average amplitude is lower than a first threshold;

b) monitoring, from the time the engine has been turned off, the signal over a second period of time, the sensor pipe being considered clogged when the integral of the signal over said second period of time is greater than a second threshold.

According to advantageous, but not compulsory aspects of the invention, the method can include one or more of the following features, considered solely or in combination:

The first period of time is comprised between 5 s and 10 s.

Said second threshold is variable depending on the exhaust gas pressure at the time the engine is shut off. To perfectly clear, the terms "is shut off" refer to the verb "shutting" and not the state of the engine itself.

Basically, the time at which the engine is shut off is the time at which the driver operates the ignition key (or the like) to turn off the engine, i.e. the time at which the engine switches from the ON state (running) to the OFF state (not running).

The first threshold is variable depending on the operating point of the engine.

Said first threshold is a percentage, typically 50%, of an expected normal average amplitude, which can be derived from a theoretical model or experiment.

Said second threshold is a percentage, typically 50%, of an expected normal pressure integral. The "expected normal pressure integral" is the value of the integral in normal conditions, that is when the sensor pipe is not clogged.

The second period of time, which corresponds to the period between the time at which the engine is shut off and the time at which an electronic control unit of the engine is shut off, is comprised between 1 and 10 s.

A signal is sent to the driver when the sensor pipe is detected as being clogged, such signal is preferably a light that is displayed on the vehicle dashboard.

The steps of the method are iteratively implemented as long as the electronic control unit of the engine is on.

The first time period is chosen to be superior to at least two, preferably three, successive combustion phases of the ignition cycle. In known manner, an ignition cycle comprises as many combustion phases as cylinders.

The first time period is set to be equal to the time it takes for the engine crankshaft to reach a certain Crank Angle Degree, which is inherent to the number of cylinders of the engine. In known manner, in a four-stroke engine, the crankshaft turns twice for the ignition cycle.

Said certain Crank Angle degree is equal to 22.5° for a 4-cylinder application and 15° for a 6-cylinder application.

The method includes preliminary steps consisting in monitoring one or more operating parameters of the engine, such as i) the engine speed and torque or ii) the fuel consumption and in checking that said operating parameter(s) is or are stable, i.e. that a steady operation state has been reached, before proceeding with step a).

The invention also concerns an internal combustion engine (ICE) assembly comprising an exhaust manifold, a pressure sensor and a sensor pipe extending between the exhaust manifold and the pressure sensor. According to the invention, said engine assembly further includes an Electronic Control Unit (ECU) for detecting clogging of the sensor pipe, using the method as defined above. Typically, the ECU it is referred to is preferably the Control unit of the engine, which means that there is one and the same ECU for controlling the engine and for implementing the method of diagnostic of the invention.

Preferably, the engine is a four-stroke engine. It can be either a CI (compression Ignition) engine or a SI (Spark Ignition) engine.

Preferably, wirings or wireless means connect the Electronic Control Unit (ECU) to the pressure sensor.

Advantageously, the Electronic Control Unit is configured for receiving one or more operating parameters of the engine, such as i) the engine speed and torque or ii) the fuel consumption and for processing the received information to check that said operating parameter(s) is or are stable over time, i.e. that a steady operation state has been reached, before implementing step a) of the method.

Eventually, the invention concerns a vehicle comprising an internal combustion engine assembly as defined above.

Typically, the vehicle is a medium-duty or heavy-duty vehicle, such as a truck.

Further advantages and advantageous features of the invention are disclosed in the following description.

BRIEF DESCRIPTION OF THE DRAWINGS

With reference to the appended drawings, below follows a more detailed description of two embodiments of the invention cited as examples.

In the drawings.

DETAILED DESCRIPTION OF EXAMPLE EMBODIMENTS OF THE INVENTION

Figure 1:
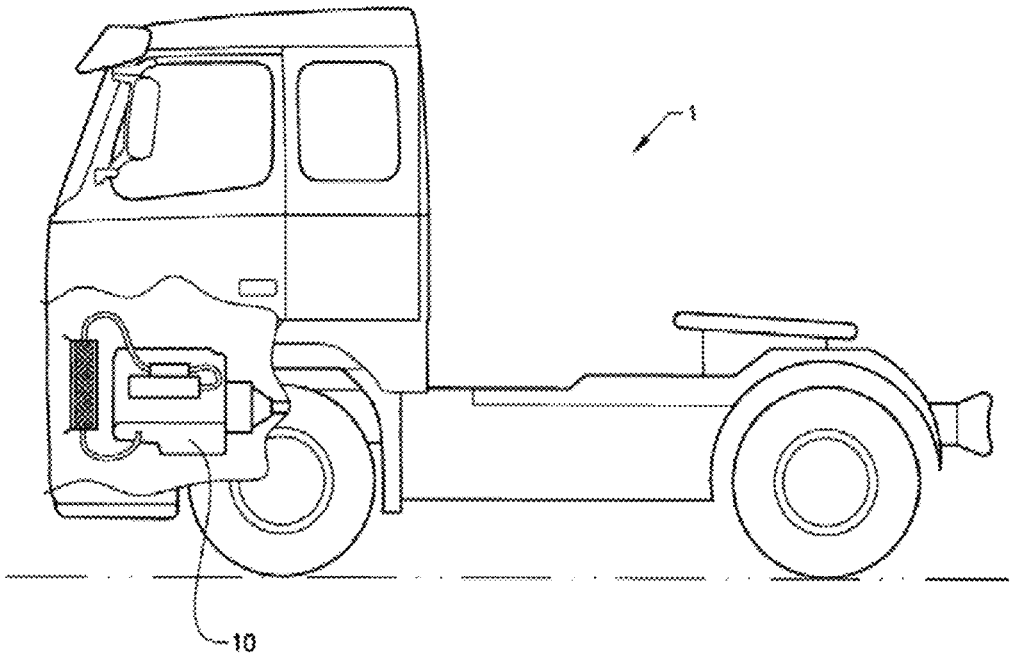
FIG. 1 is a schematic view of a heavy-duty vehicle, typically a truck, comprising an internal combustion engine having an inlet manifold and an outlet manifold.

FIG. 1 represents a heavy-duty vehicle, typically a truck 1. The truck 1 includes an Internal Combustion Engine (ICE) assembly 10 comprising an inlet manifold (or intake manifold) that is not shown in detail and an outlet manifold (or exhaust manifold) 12, represented in detail on FIG. 2.

In variant, the invention can obviously be applied to other types of vehicles, typically to any vehicle comprising an internal combustion engine: It can be a bus, a passenger car, a boat or a working machine.

The ICE assembly 10 further comprises a pressure sensor 14 and a sensor pipe 16 extending between the exhaust manifold 12 and the pressure sensor 14. In the following, sensor pipe 16 can be referred to as the "P3 pipe".

The pressure sensor 14 enables to record a signal representative of the relative pressure inside the exhaust manifold 12 over the time.

Figure 2:
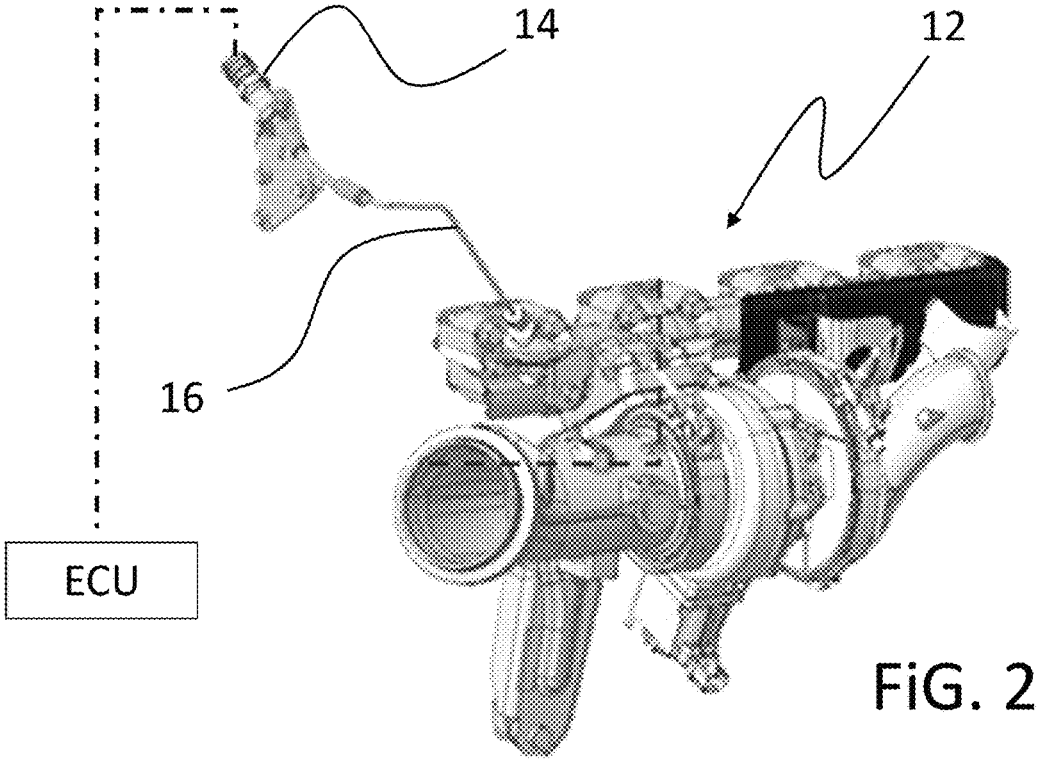
FIG. 2 is a detailed view of the outlet manifold of the internal combustion engine of FIG. 1, representing an exhaust pressure sensor connected to the exhaust manifold via a sensor pipe.

The ICE assembly 10 further includes an Electronic Control Unit (ECU), represented on FIG. 2, for detecting the clogging of the sensor pipe 16, using a specific method detailed below.

Typically, the ECU is connected to the pressure sensor 14, through wire(s) or wirelessly, so that the data measured by the pressure sensor 14 are sent as input parameter to the ECU.

Advantageously, the above-mentioned ECU is the ECU controlling the operation of the engine. Typically, this ECU controls, among others, the strategy of fuel injection into the cylinders of the engine, depending on the acceleration requested by the driver (throttle input). In a variant, the ECU that is used to implement the method of the invention can be different from that of the ECU controlling the operation of the engine, which means that it can be a different (additional) ECU.

Normally, the exhaust pressure (or "Back pressure") has at least two pikes.

The first pike is produced by the cylinders spontaneous discharge due to the opening of the exhaust valves. Before the end of each of the engine's working stroke, the exhaust valve opens and the high-pressure combustion exhaust is released into the exhaust manifold. Due to the intermittent opening and closing of the exhaust door of the engine, the high pressure exhaust from the cylinder is transmitted along the exhaust manifold in the form of compression wave pulse.

The second pike is due to the ascending movement of the piston. This phase finishes when the piston reaches the upper dead point (or Top Dead Center), namely at the end of the exhaust stroke and at the beginning of intake stroke respectively.

Those wave pulses reach highly noticeable values even at idle conditions and with a fully functional P3 pipe 16. When the pipe 16 is partially clogged, this value is decremented (approximately 5-6 times its normal value). When the P3 pipe 16 gets fully clogged, the pressure value measured by the sensor 14 gets steady, meaning that oscillations are no longer detected.

This is due to the constitution of the plug (not shown) which has naturally been formed inside the P3 pipe 16. Precisely, this plug (or obstruction) has a porous constitution, so that the actual amplitude of the pressure wave that enters to the P3 pipe 16 gets filtered once it passes through the plug.

Figure 3:
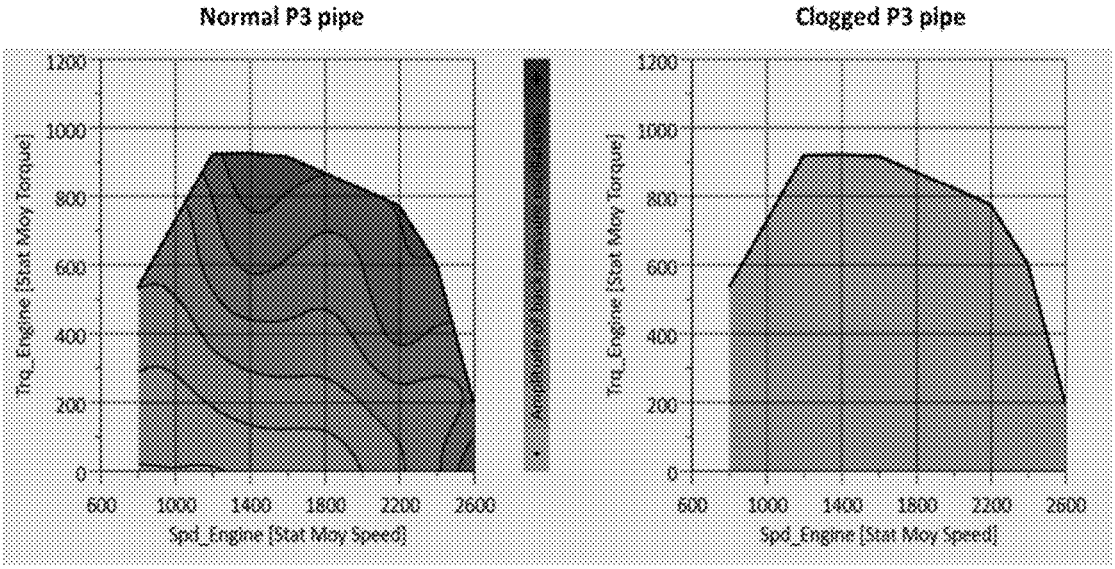
FIG. 3 includes two maps representing the amplitude of the Exhaust manifold pressure oscillations depending on the engine operating point (Torque, speed), for a non-clogged P3 pipe and a clogged P3 pipe.

FIG. 3 reflects the different behaviours between the pressure value measured by the P3 sensor 14 with a "normal" P3 pipe 16 (i.e. a pipe that is not clogged) and a clogged P3 pipe.

Normally, the amplitude of the P3 oscillations is greater at high engine load (engine torque) and high engine speed (red field in engine map). It can be noticed that with a clogged P3 pipe (right picture), the amplitude of the P3 oscillations remains constant in all engine map.

Even at idle conditions (Engine ON, vehicle stopped), the difference is noticeable between both cases. Nevertheless, the greatest difference can be found at high engine load and speed.

Figure 4:
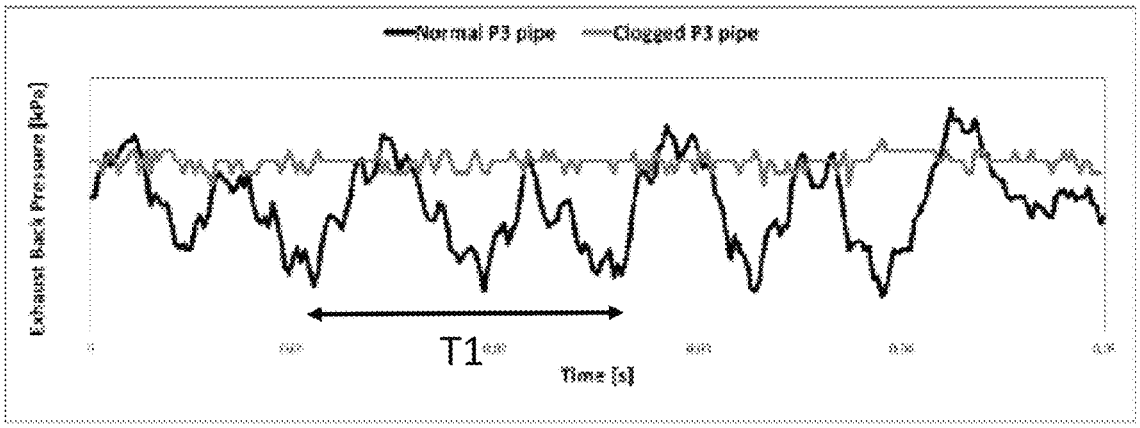
FIG. 4 is a graph showing the evolution of the pressure sensor measurements over time, when the sensor pipe is normal (not clogged) and when the sensor pipe (P3 pipe) is clogged.
Figure 5:
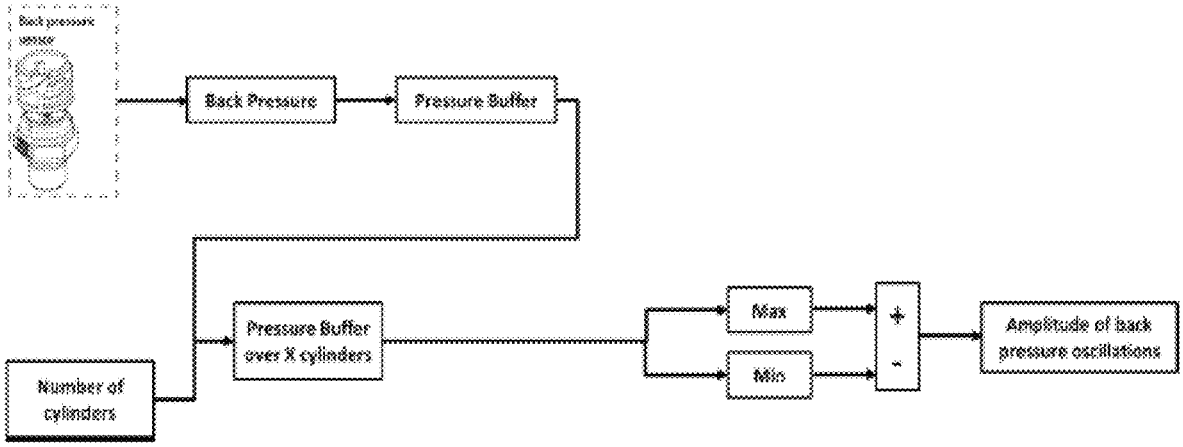
FIG. 5 is a flowchart representing the steps of the method of the invention, i.e. the method for the detection of P3 pipe clogging by monitoring back pressure oscillations.

In the Embodiment of FIGS. 4 and 5 (Embodiment a)), the method for detecting P3 pipe clogging consists in determining, while the engine 10 runs in a steady operation state, an average amplitude A1 of oscillations of the signal (recorded by sensor 16) over a first period of time T1.

For the record, the engine is considered to be in a "steady operation state" when the amount of fuel injected in the engine cylinders is approximately stable over time. This is to be opposed to a "transient state" in which the amount of fuel is not really stable. The "steady operation state" can also be known as a state in which the engine speed and torque remain constant.

Therefore, and in order to determine whether the engine is in a steady operation state, the ECU can monitor the evolution of the amount of fuel injected into the engine cylinders. Since such control is known as such, it is not detailed further herein.

Typically, an example of a steady operation state is the "idle state" in which the vehicle is stopped with the engine ON and disengaged from the wheels. Another example of a steady operation state is the "coasting state", in which the vehicle is moving with engine ON and disengaged from the wheels. Another example of a steady operation state is the "cruising state" in which the vehicle moves at a constant speed on a flat road.

Typically, the first period of time T1 is comprised between 5 s and 10 s.

In detail, and as represented on FIG. 4, the ECU monitors the (electrical) signal recorded by the pressure sensor 14. This signal is usually known as representing the "Back Pressure" that is the pressure inside the exhaust manifold.

Figure 8:
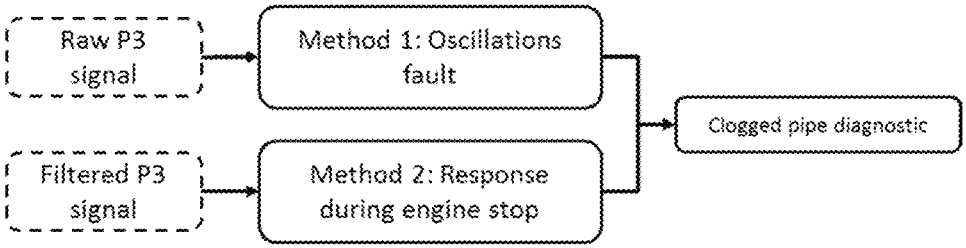
FIGS. 8 and 9 are two flow charts roughly representing the steps of the two alternative methods of the invention.
Figure 9:
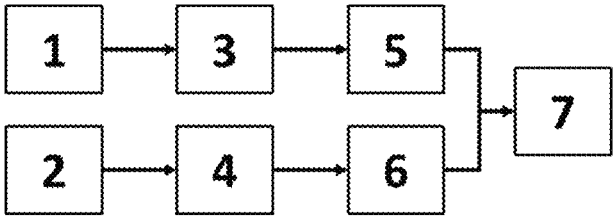

In this embodiment, and as shown on FIGS. 8 and 9, the method includes the following steps:

Exhaust Back Pressure Fast Acquisition (1):

In the example, the exhaust back pressure ("raw" pressure) is acquired every certain CAD slot (Crank Angle Degree), which is inherent to the number of cylinders of the engine. Typically, the exhaust back pressure can be acquired every 22.5° CAD (Crank Angle Degree) for a 4-cylinder application and every 15° CAD for a 6-cylinder application.

Crankshaft degrees is a unit (equal to one "ordinary" degree) that is used to measure the piston travel (position) e.g. to adjust ignition. A four-stroke cycle engine is an internal combustion engine that utilizes four distinct piston strokes (intake, compression, power, and exhaust) to complete one operating cycle. The piston makes two complete passes in the cylinder to complete one operating cycle. An operating cycle involves two revolutions (720°) of the crankshaft. In other words, in a four-stroke engine, the crankshaft turns twice for the ignition cycle. When the piston is at its highest point, known as the Top Dead Center (TDC), the crankshaft angle (crank angle) is at 0° crank angle degree.

As shown on FIG. 5, the "raw" pressure is stored in a buffer to make it exploitable for next steps.

This step corresponds to an exhaust back pressure fast acquisition (Step 1 on FIG. 9).

Exhaust Back Pressure Oscillations (3):

As shown on FIG. 5, the next step is to build a back pressure buffer, i.e. a data buffer. This data buffer stores all the exhaust back pressure data measured by the sensor 14 at each crankshaft angular event (which is inherent to the number of cylinders of the engine), so the software solution can monitor the exhaust back pressure wave(s).

The amplitude of the exhaust pressure wave is then obtained from the difference between the maximum and the minimal value stored into this data buffer.

In order to improve the robustness of the solution and to avoid biasing the diagnostic because of misfire phenomena (when one or more of the cylinders inside the engine fail to fire correctly), the buffer length (i.e. the time period T1 on FIG. 4) can be modified in order to take into account the exhaust pressure waves of not only one cylinder, but of a plurality of cylinders.

Indeed, when a misfire happens in one cylinder, the amplitude of the pressure wave will drastically decrease, and this could be mistaken with a clogged P3 pipe.

In other words, it is known that the cylinders of an internal combustion engine are ignited following a specific cycle that is known as the ignition cycle. This means that the combustion phases inside the cylinders are carried out sequentially in time. Accordingly, an ignition cycle includes a plurality of successive combustion phases, whose number obviously depends on the number of the cylinders of the engine. Typically, the number of combustion phases during the ignition cycle is equal to the number of cylinder of the engine.

If the time period T1 would be chosen as inferior or equal to the combustion phase of one cylinder, and that misfire happens in that specific cylinder, then the amplitude of the measured wave would be very low and this could be interpreted as arising from pipe clogging. To avoid such misinterpretation, the time period T1 is chosen to encompass at least two, preferably three successive combustion phases (in three different cylinders), i.e. to last enough time to record the data during at least two, preferably three successive combustion phases. More precisely, the time period T1 can be chosen so that the whole sequence of ignition can be recorded. In that way, the wave pulses can be detected even if the combustion inside one or more of the engine cylinders has failed.

In the example of FIG. 4, the time period T1 has been chosen to encompass two combustion phases (since it encompasses tow pikes).

Exhaust Back Pressure Oscillations Diagnostic (5):

In order to start the evaluation, the Air & Gas actuators of the engine (including the Intake Throttle Valve (ITV), the Exhaust Pressure Governor (EPG), the EGR (Exhaust Gas Recirculation) Valve and Variable Geometry Turbine (VGT)) should reach a target position. In addition, Engine Speed and Torque should reach a target position as well and remain at a steady state.

It is possible, by calibration, to reach any point in the engine map. The points around idle speed could benefit from a high level of opportunities during a driving cycle to perform successful evaluations. Nevertheless, even if the difference in terms of amplitude of back pressure oscillations between a clogged pipe and a non-clogged P3 pipe is very noticeable, it would be preferable to run the diagnostic when the engine is in idle operation state.

Once said conditions are fulfilled, the software (i.e. the ECU) will start the amplitude evaluation of the back exhaust pressure oscillations.

Precisely, the ECU calculates the average amplitude of the back pressure waves during the time period T1. To do that, and as shown on FIG. 5, the ECU determines the maximum value and the minimum values of the signal and proceeds with the difference between the maximum value and the minimum value of each pulse to calculate the amplitude of said pulse. The ECU then calculates the average amplitude by making the sum of all amplitudes divided by the number of pulse events (or pikes) in the recorded signal during the period T1.

The sensor pipe 16 is considered as being clogged when said average amplitude is lower than a first threshold. In this case, a signal is sent to the driver. Such signal is preferably a light that is displayed on the vehicle dashboard.

In the example, the first threshold is variable depending on the operating point of the engine, which is given by the engine torque and speed. Indeed, and as mentioned above, the higher are the engine load (torque) and speed, the higher are the amplitude of the oscillations.

Engine torque and speed are parameters that are known at each time. In other words, these are input parameters to the ECU provided for controlling the operation of the engine.

Basically, the first threshold can be derived from a pre-established 3D-map in which the first threshold (1D) is determined for each engine speed (2D) and torque (3D). Such 3D-map can be based on experiment and/or on a theoretical model.

Typically, said first threshold is a percentage, for example 50%, of an expected normal average amplitude.

Another abnormal behaviour that can be detected through the method is a slow "response" of the P3 sensor 14 during a specific event, in which the exhaust pressure is expected to change. For example, it is known that, when the engine is turned off, the pressure inside the exhaust manifold (or Exhaust back pressure) is expected to drop to the atmospheric pressure. However, when a plug (or obstruction) is formed inside the P3 pipe 16, i.e. when the P3 pipe is clogged, the plug acts as a filter, which implies that the signal measured by the P3 sensor 14 does not change as fast as the real pressure inside the exhaust manifold. Typically, when the P3 pipe is clogged, the pressure sensor 16 can measure a pressure drop of 10 kPa during 1 ms (for example), while the real pressure inside the exhaust manifold has dropped by 50 kPa during the same time period. The evolution of the signal recorded by the pressure sensor 14 after a specific event (at which the pressure is expected to change) is known as the "response" of the signal.

Figure 6:
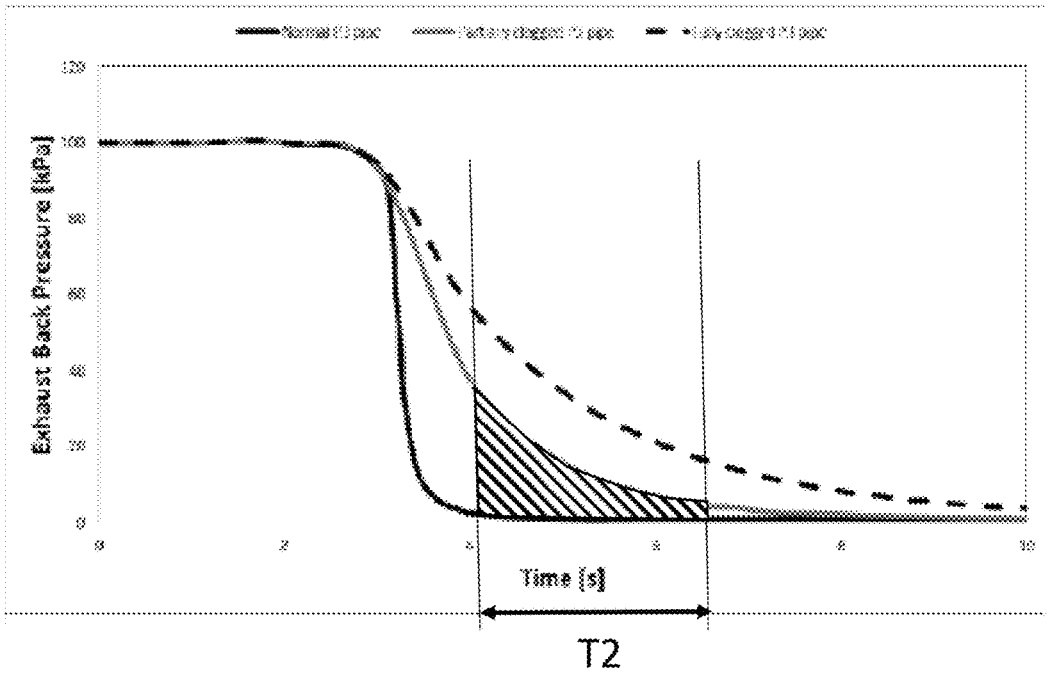
FIG. 6 is a graph showing the evolution of the pressure sensor measurements over time after the Internal Combustion Engine (ICE) is turned off, when the sensor pipe is normal (not clogged) and when the sensor pipe (P3 pipe) is clogged.
Figure 7:
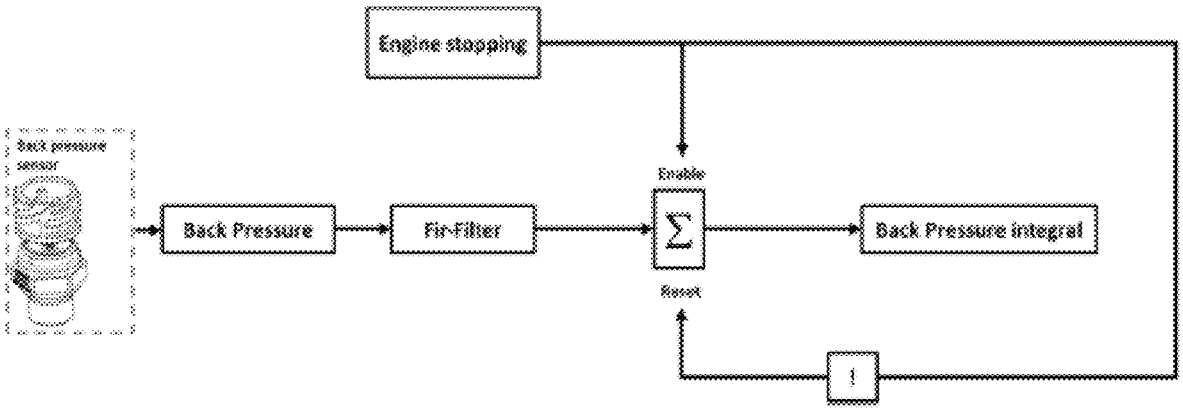
FIG. 7 is a flowchart representing the steps of the method of the invention, i.e. the method for the detection of P3 pipe clogging, by monitoring the evolution of the back pressure before it drops to zero bar (relative pressure)

In the Embodiment of FIGS. 6 and 7 (Embodiment b)), the method consists in monitoring, from the time the engine 10 has been turned off (or switched off), the signal over a second period of time T2.

In the example, the second period of time corresponds to the period between the time at which the engine 10 is shut off and the time at which the Electronic Control Unit (ECU) of the engine 10 is shut off. This period of time is comprised between 1 s and 10 s.

In this embodiment, and as shown on FIGS. 8 and 9, the method includes the following steps:

Exhaust Back Pressure Filtered (2):

In this method, the "raw" exhaust back pressure measured by the sensor 14 is filtered by means of a Finite Impulse Response (FIR) filter in order to prepare the signal for the next steps. This step corresponds to the exhaust back pressure filtration (Step 2 on FIG. 9).

Exhaust Back Pressure Response (4):

A target exhaust back pressure can be set by the ECU of the ICE, as a function of the operation point (speed, torque) of the engine. In this respect, the exhaust back pressure can be controlled by different actuators, such as the EPG, VGT, ITV or WG (Waste Gate) in order to reach said target exhaust back pressure. Typically, when engine braking is to be achieved, then the Back pressure has to be increased up to a high target in order to enhance braking effect. Another example in which the Back pressure needs to be increased is to help the engine to quicker reach the appropriate working temperature, for instance to regenerate one or more components of the EATS, such as the DPF.

Normally, when a new target exhaust back pressure is set, the pressure value measured by the pressure sensor 14 should normally change to meet the new target (with a time response of maximum 500 ms). However, if the P3 pipe 16 to which is connected the sensor 14 is clogged, the time response can be longer, for example of 900 ms.

The goal of this diagnostic is to detect when the "response" of the pressure sensor 14 gets slowed down, in order to detect that the P3 pipe 16 is getting clogged.

To do so, an evaluation is performed at each engine stop.

When the engine is turned off (i.e. when the ignition key is switched off), the back pressure (which is considered here as a relative pressure) normally drops to 0 kPa. Thus, an evaluation can be performed at least one time at each driving cycle.

When a potential diagnostic zone is detected, the integral of the filtered back pressure signal [obtained in step (2)] is calculated. Indeed, the integral value is an indicator for the rapidity of the back pressure decrease. So, the higher is the integral, the slower is the signal decrease (or signal drop).

On FIG. 6, the integral of the first signal (partially clogged pipe) is represented by the hatched area. For the clarity of the drawing, we have not represented the integral of the two other curves over the same period T2. Nevertheless, one can easily see that the integral of the curve corresponding to the signal measured with a clogged pipe is higher than that in the partially clogged configuration, which is itself higher than that in the normal configuration.

To discretize this, this integral is considered as a back pressure "accumulator" during the second period of time T2.

FIG. 6 enables to compare the response in three different situations: P3 pipe not clogged or normal (the most thicker/darker line), partially clogged (the thin line) and fully clogged (the dashed line).

Exhaust Back Pressure Slow Response Diagnostic (6):

To determine if the integral value of the back exhaust pressure is usable to perform the diagnostic, two more complementary conditions can be considered when the engine is turned off (i.e. switched from "On" state to "Off" state):

(1) Engine speed conditions: At the time the engine is turned off, the engine speed value should be between a predefined interval. This is to avoid, prior to the engine stop, engine speed accelerations that may interfere in the back pressure behaviour.

(2) Back exhaust pressure conditions: At the time the engine is turned off, the back pressure value should be between a predefined interval. This is to improve diagnostic robustness, by avoiding too low or too high back pressure levels at engine stopping phase that may have an impact in the back pressure integral calculation.

If all the conditions are fulfilled, then the integral value calculated in step (4) is compared to a second threshold (or fault limit).

Typically, said second threshold is variable depending on the exhaust gas pressure at the time the engine has been turned off.

Indeed, the higher is the exhaust back pressure when the engine is turned off, the longer is the time to reach the atmospheric pressure.

Basically, the second threshold can be derived from a pre-established 1D-map in which the second threshold (1D) is determined for each exhaust back pressure. Such 1D-map can be established using experimental data and/or on a theoretical model.

For example, said second threshold is a percentage, typically 50%, of an expected normal pressure integral.

A fault will be detected if the integral value of the exhaust back pressure is greater than this fault limit. This means that the sensor pipe 16 is considered as being clogged when the integral of the signal is greater than the second threshold.

Final Decision (7):

Once one evaluation is completed, the results are processed in order to evaluate the final state of the diagnostic.

It is possible, by calibration, to set an alarm in two different ways:

(1) An alert is triggered as soon as one of the sub-diagnostics (back pressure oscillations or back pressure response) has led to the conclusion that the P3 pipe is clogged; or (2) The alert is triggered only if both sub-diagnostics (back pressure oscillations and back pressure response) have led to the conclusion that the P3 pipe is clogged. This means that no alert is triggered if the conclusion of one of the sub-diagnostics is that the P3 pipe is not clogged.

Typically, when the driver receives the alert signal, he has to go the workshop and the P3 pipe should be changed.

Last, but not least, the steps of the method are iteratively implemented as long as the Electronic Control Unit of the engine is on. Basically, the ECU is ON as long as the driver has turned the ignition key in the key lock to awake the system.

It is to be understood that the present invention is not limited to the embodiments described above and illustrated in the drawings; rather, the skilled person will recognize that many changes and modifications may be made within the scope of the appended claims.

The invention claimed is:

1. A method for automatically detecting clogging of a sensor pipe extending between a pressure sensor and an exhaust manifold of an internal combustion engine, wherein the pressure sensor enables to record a signal representative of a relative pressure over time, the method comprising:

monitoring, from a time the internal combustion engine has been turned off, the signal over a second period of time (T2), the sensor pipe being considered clogged when an integral of the signal over the second period of time (T2) is greater than a second threshold; and triggering an alert towards an operator of the internal combustion engine when the sensor pipe is considered clogged.

2. The method according to claim 1, wherein the second threshold is variable depending on an exhaust gas pressure at the time the engine is shut off.

3. The method according to claim 1, wherein the second threshold is a percentage of an expected normal pressure integral.

4. The method according to claim 1, wherein the second period of time, which corresponds to a period between the time at which the engine is turned off and a time at which an electronic control unit (ECU) of the internal combustion engine is shut off, is between 1 second and 10 seconds.

5. The method according to claim 1, wherein the alert comprises a light that is displayed on a vehicle dashboard.

6. An internal combustion engine assembly comprising:

an exhaust manifold;

a pressure sensor that enables to record a signal representative of a relative pressure over time;

a sensor pipe extending between the exhaust manifold and the pressure sensor; and an Electronic Control Unit (ECU) for detecting clogging of the sensor pipe by:

monitoring, from a time the internal combustion engine has been turned off, the signal over a second period of time (T2), the sensor pipe being considered clogged when an integral of the signal over the second period (T2) of time is greater than a second threshold; and triggering an alert towards an operator of the internal combustion engine if when the sensor pipe is considered clogged.

7. The internal combustion engine assembly according to claim 6, wherein the internal combustion engine comprises a four-stroke engine.

8. The internal combustion engine assembly according to claim 6, characterized in that wirings or wireless means connect the Electronic Control Unit (ECU) to the pressure sensor.

9. A vehicle comprising the internal combustion engine assembly according to claim 6.

10. The vehicle according to claim 9, wherein the vehicle comprises a medium-duty or heavy-duty vehicle comprising a truck.

* * * * *